US010895427B2

(12) United States Patent
Maga

(10) Patent No.: US 10,895,427 B2
(45) Date of Patent: Jan. 19, 2021

(54) LOADABLE FIXED MAGAZINE FOR FIREARMS

(71) Applicant: David Maga, Castaic, CA (US)

(72) Inventor: David Maga, Castaic, CA (US)

( * ) Notice: Subject to any disclaimer, the term of this patent is extended or adjusted under 35 U.S.C. 154(b) by 35 days.

(21) Appl. No.: 16/361,854

(22) Filed: Mar. 22, 2019

(65) Prior Publication Data

US 2019/0219348 A1 Jul. 18, 2019

Related U.S. Application Data

(63) Continuation-in-part of application No. 15/784,078, filed on Oct. 13, 2017, now Pat. No. 10,598,457.

(60) Provisional application No. 62/794,455, filed on Jan. 18, 2019, provisional application No. 62/483,827, filed on Apr. 10, 2017, provisional application No. 62/483,814, filed on Apr. 10, 2017, provisional application No. 62/483,822, filed on Apr. 10, 2017.

(51) Int. Cl.

| | |
|---|---|
| ***F41A 9/00*** | (2006.01) |
| ***F41A 9/67*** | (2006.01) |
| ***F41A 9/82*** | (2006.01) |
| ***F41A 17/38*** | (2006.01) |

(52) U.S. Cl.

CPC *F41A 9/67* (2013.01); *F41A 9/82* (2013.01); *F41A 17/38* (2013.01)

(58) Field of Classification Search

CPC ..... F41A 9/65; F41A 9/67; F41A 9/83; F41A 9/71; F41A 17/38

USPC ..... 42/50, 49.01, 18, 87

See application file for complete search history.

(56) References Cited

U.S. PATENT DOCUMENTS

| | | | | | |
|---|---|---|---|---|---|
| 1,797,951 | A * | 3/1931 | Gaidos | F41A 9/67 | 42/50 |
| 2,477,936 | A * | 8/1949 | Molins | F41A 9/76 | 89/33.17 |
| 2,585,738 | A * | 2/1952 | Chapin | F41A 9/55 | 42/18 |
| 2,908,987 | A * | 10/1959 | Allyn | F41A 9/65 | 42/18 |
| 3,005,279 | A * | 10/1961 | Brewer | F41A 13/00 | 42/18 |

(Continued)

*Primary Examiner* — Michael D David

(74) *Attorney, Agent, or Firm* — Manning & Kass, Ellrod Ramirez Trester LLP; Roland J. Tong

(57) ABSTRACT

A loadable ammunition magazine for use with a sporting firearm includes a housing defining a cartridge-loading compartment and a follower compartment, a cover that alternately covers and reveals the cartridge-loading compartment, and a follower that urges cartridges in the cartridge-loading compartment towards a mouth of the magazine. A locking assembly prevents the magazine from being detached from the lower receiver of the firearm without disassembly of the firearm action designed for use with AK-47-style rifles having stamped receivers, the locking assembly comprises a locking bar including a horizontal lower flange that is secured by a threaded fastener to the top wall of the magazine housing and a horizontal upper flange that rests on the cross rivet of the receiver. In another embodiment, designed for use with AK-47-style rifles having machined receivers, the locking assembly comprises a locking bar including a horizontal upper flange that is secured by a threaded fastener to the top wall of the magazine housing and a horizontal lower flange that rests on the bottom wall of the receiver.

15 Claims, 8 Drawing Sheets

(56) References Cited

U.S. PATENT DOCUMENTS 4,430,821 A * 2/1984 Vincent ..... F41A 9/67 42/50
4,502,237 A * 3/1985 Krogh ..... F41A 9/70 42/50
4,588,240 A * 5/1986 Ruehl ..... H01R 31/08 439/513
4,614,052 A * 9/1986 Brown ..... F41A 9/83 42/50
4,688,344 A * 8/1987 Kim ..... F41A 9/83 42/50
4,707,941 A * 11/1987 Eastman ..... F41A 9/68 42/49.02
5,278,690 A * 1/1994 Vella-Coleiro ..... H04B 7/2675 379/379
5,461,811 A * 10/1995 Ciener ..... F41A 9/65 42/49.02
5,697,179 A * 12/1997 Vanmoor ..... F41A 9/65 42/50
5,732,498 A * 3/1998 Arreguin ..... F41A 17/44 42/70.02
5,806,224 A * 9/1998 Hager ..... F41A 17/38 42/18
6,212,815 B1 * 4/2001 Fitzpatrick ..... F41A 9/65 224/196
6,311,603 B1 * 11/2001 Dunlap ..... F41A 3/72 42/2
6,481,136 B1 * 11/2002 Fitzpartick ..... F41A 9/65 42/18
6,739,082 B2 * 5/2004 Christensen ..... F41A 9/61 42/49.02
6,807,764 B1 * 10/2004 Phillips ..... F41A 9/83 42/87
7,162,824 B1 * 1/2007 McCormick ..... F41A 19/10 42/75.03
7,200,964 B2 * 4/2007 Gates ..... F41A 9/67 42/49.01
7,444,775 B1 * 11/2008 Schuetz ..... F41A 9/71 42/49.02
7,497,044 B2 * 3/2009 Cammenga ..... F41A 9/67 42/49.01
7,941,955 B2 * 5/2011 Stone ..... F41A 9/25 42/50
8,316,567 B2 * 11/2012 Douglas ..... F41A 9/67 42/50
8,418,390 B1 * 4/2013 Wright ..... F41A 9/61 42/49.01
8,720,095 B2 * 5/2014 Wright ..... F41A 9/65 42/50
8,756,845 B2 * 6/2014 Harris ..... F41A 9/65 42/49.01
9,103,614 B2 * 8/2015 Froehle ..... F41A 9/67
9,121,652 B1 * 9/2015 Mangiameli ..... F41A 9/67
9,303,934 B1 * 4/2016 Kazsuk ..... F41A 9/83
9,341,421 B2 * 5/2016 Findlay ..... F41A 9/65
9,395,130 B2 * 7/2016 Jacobson ..... F41A 9/65
9,482,478 B2 * 11/2016 Newman ..... F41A 21/02
9,683,797 B2 * 6/2017 Boyarkin ..... F41A 9/66
2011/0173858 A1 * 7/2011 Troy ..... F41A 9/65 42/50
2012/0102803 A1 * 5/2012 Troy ..... F41C 23/16 42/71.01
2014/0223790 A1 * 8/2014 Wilson ..... F41A 9/65 42/49.01
2015/0096214 A1 * 4/2015 Jones, III ..... F41A 9/71 42/49.01
2015/0276339 A1 * 10/2015 Shreve ..... F41A 9/71 42/50
2018/0292153 A1 * 10/2018 Maga ..... F41A 9/67
2018/0292154 A1 * 10/2018 Maga ..... F41A 9/67
2018/0292155 A1 * 10/2018 Maga ..... F41A 9/67
2018/0292156 A1 * 10/2018 Maga ..... F41A 3/66
2019/0219348 A1 * 7/2019 Maga ..... F41A 9/67

* cited by examiner

LOADABLE FIXED MAGAZINE FOR FIREARMS

CROSS-REFERENCE TO RELATED APPLICATIONS

This application claims priority from U.S. provisional patent application No. 62/794,455, filed Jan. 18, 2019.

In addition, this application is a continuation-in-part of U.S. patent application Ser. No. 15/784,078, filed Oct. 13, 2017, now US publication no. US2018/0292153 A1. U.S. patent application Ser. No. 15/784,078 claims priority from the following three U.S. provisional patent applications: Ser. No. 62/483,814, filed Apr. 10, 2017; Ser. No. 62/483,822, filed Apr. 10, 2017; and Ser. No. 62/483,827, filed Apr. 10, 2017. The entire contents of each of the above provisional applications are incorporated herein by reference.

TECHNICAL FIELD

The present disclosure relates in general to magazines for firearms and, more particularly, to loadable fixed magazines for firearms.

BACKGROUND

Concern over mass shootings in America has led some U.S. states such as California and New York to ban the use of "assault-style" weapons. The definition of "assault style" weapons varies from state-to-state, but in California semi-automatic rifles such as AR-15s or AK47s with detachable magazines fall under this umbrella. Specifically, current California law requires that all semi-automatic rifles using centerfire ammunition must be at least 30" in length and must have fixed magazines that hold no more than 10 rounds, where a "fixed magazine" is defined as a magazine that cannot be removed without disassembly of the firearm action.

In response to this legislation, firearms manufacturers have begun manufacturing and selling semiautomatic firearms with fixed magazines. Examples of such firearms are disclosed in U.S. Pat. No. 5,806,224 to Hager, and U.S. Pat. No. 7,941,955 B2. For gun owners who wish to avoid the expense of buying new guns, kits for converting firearms with detachable magazines to firearms with fixed magazines are also available. One such kit is disclosed in U.S. Pat. No. 8,756,845 B2. However, a need exists for other ways of bringing non-compliant sporting rifles into compliance with the laws of California and other states.

SUMMARY

The present disclosure relates to an ammunition magazine for use with a firearm having a receiver including a lower opening for receiving the ammunition magazine. The ammunition magazine includes a housing having an upper portion configured to be inserted into the lower opening of the receiver, and a lower portion configured to extend downwardly below the receiver. The housing defines a compartment configured to receive and contain a stack of ammunition cartridges. The upper end of the compartment terminates in a mouth that communicates with the interior of the receiver, and the lower end of the compartment is accessible through an opening in the lower portion of the housing. A slidable cover or door alternately covers or reveals the opening. A follower assembly within the lower portion of the housing urges ammunition cartridges in the compartment upwardly towards the mouth of the magazine.

In one aspect of the disclosure, the follower assembly comprises a follower, a finger-pull attached to the follower, and a spring. The finger-pull extends through the finger-pull slot and is movable when released from the bottom hook. The spring is configured to be compressed by the follower when the finger-pull is compressed by the follower when the finger-pull is engaged with the bottom hook, and configured to expand when the finger-pull is disengaged from the bottom hook, thereby allowing the follower to urge the stack of cartridges towards the moth of the ammunition magazine.

In some embodiments, the extension portion is configured to limit capacity of the ammunition magazine to no more than ten cartridges.

In some embodiments, the follower assembly includes: a spring guide, configured to provide support and stability for the spring and to provide alignment for the spring when in an extended position and when in a compressed position, the spring guide having a shape that fits inside the follower when the spring is in the compressed position; and a follower arm, fixedly attached to the finger-pull, with the follower arm also configured to flexibly attach to the follower, so as to allow movement of the finger-pull into the bottom hook.

In some embodiments, the cover has a pair of cover grooves, the pair of cover grooves being configured to be slidably supported by a pair of slide rails on the follower compartment.

In some embodiments, the cover has a raised cover stop ridge cooperates with a cover stop groove in the follower compartment to prevent the cover from moving beyond the cartridge-loading portion opening.

In some embodiments, the follower compartment has a magazine bottom cap which supports and protects the follower assembly.

In some embodiments, the extension portion, the cartridge-loading portion, the follower compartment, and the follower assembly are each made from at least one of: metal or plastic.

In some embodiments, the locking assembly includes an attachable locking tab at the mouth of the upper portion of the ammunition magazine housing.

In some embodiments, designed for use with AK-47-style rifles having stamped receivers, the locking assembly comprises a locking bar including a horizontal lower flange that is secured by a threaded fastener to the top wall of the magazine housing and a horizontal upper flange that rests on the cross rivet of the receiver.

In other embodiments, designed for use with AK-47-style rifles having machined receivers, the locking assembly comprises a locking bar including a horizontal upper flange that is secured by a threaded fastener to the top wall of the magazine housing and a horizontal lower flange that rests on the bottom wall of the receiver.

BRIEF DESCRIPTION OF THE DRAWINGS

The invention will be more fully understood from the following detailed description, in conjunction with the following figures, wherein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
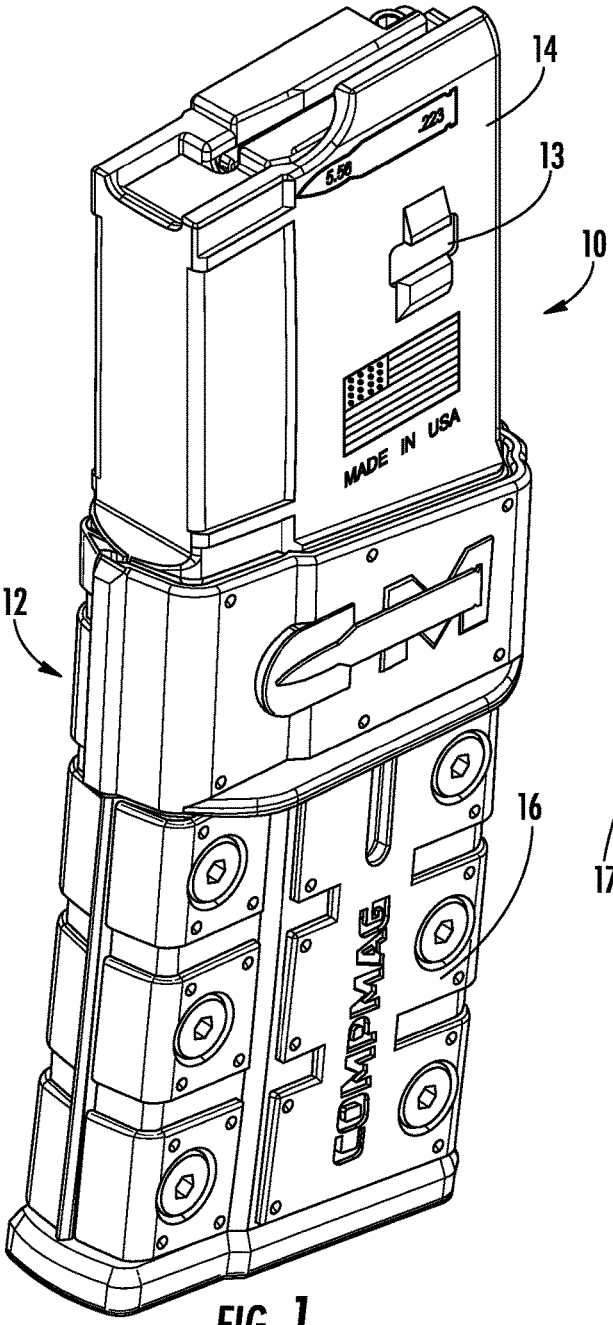
FIG. 1 is an obverse perspective view of an ammunition magazine according to one embodiment of the disclosure, with the cover in the closed position and the finger-pull in the up position.
Figure 2:
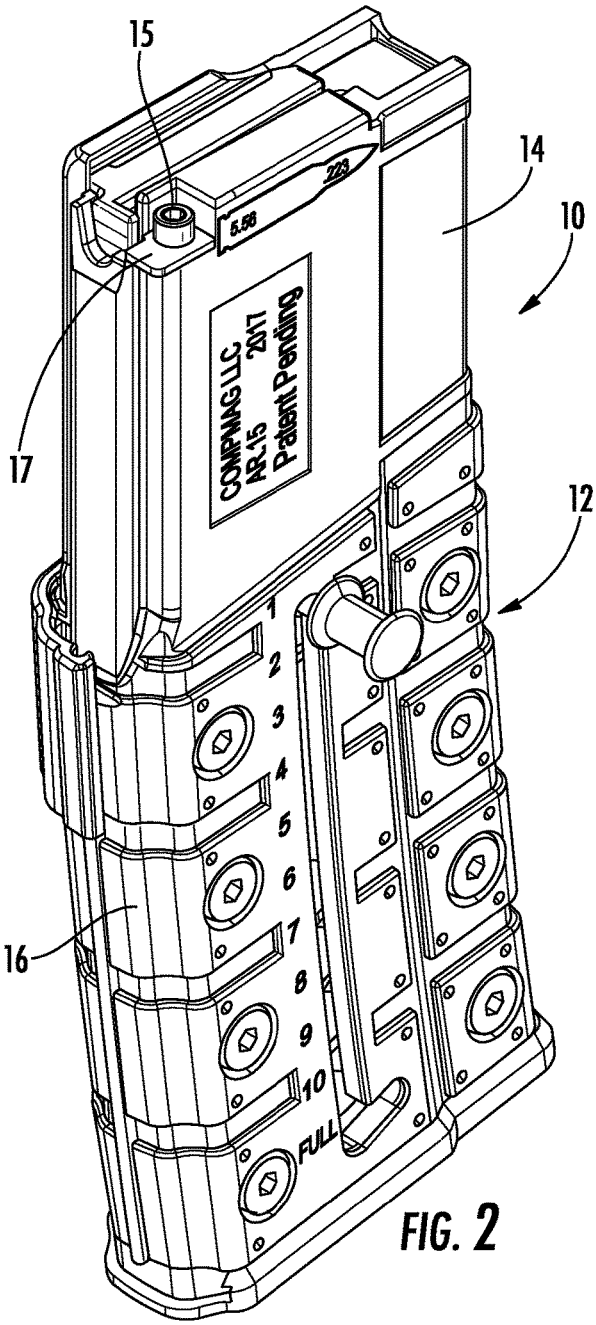
FIG. 2 shows the reverse side of FIG. 1.

With reference to FIGS. 1 and 2, an ammunition magazine of the present disclosure, indicated in its entirety by the numeral 10, includes a housing 12 having an upper portion 14 (also called an extension portion) configured to extend into a receiver of a firearm, and a lower portion 16 configured to extend downwardly below the receiver. A magazine insertion grip 13 formed on the upper portion 14 of the housing 12 is configured to be snapped into a mating recess or hole in the receiver when the ammunition magazine 10 is inserted into the receiver. In addition, a locking assembly, consisting of a locking screw 15 and an attachable blocking tab 17, is provided for securing the ammunition magazine 10 to the receiver, preventing the ammunition magazine 10 from being removed from the firearm without disassembling the firearm action. The attachable blocking tab 17 is attached after insertion of the ammunition magazine 10 into the opening in the receiver, and assembly of the firearm action.

Figure 3:
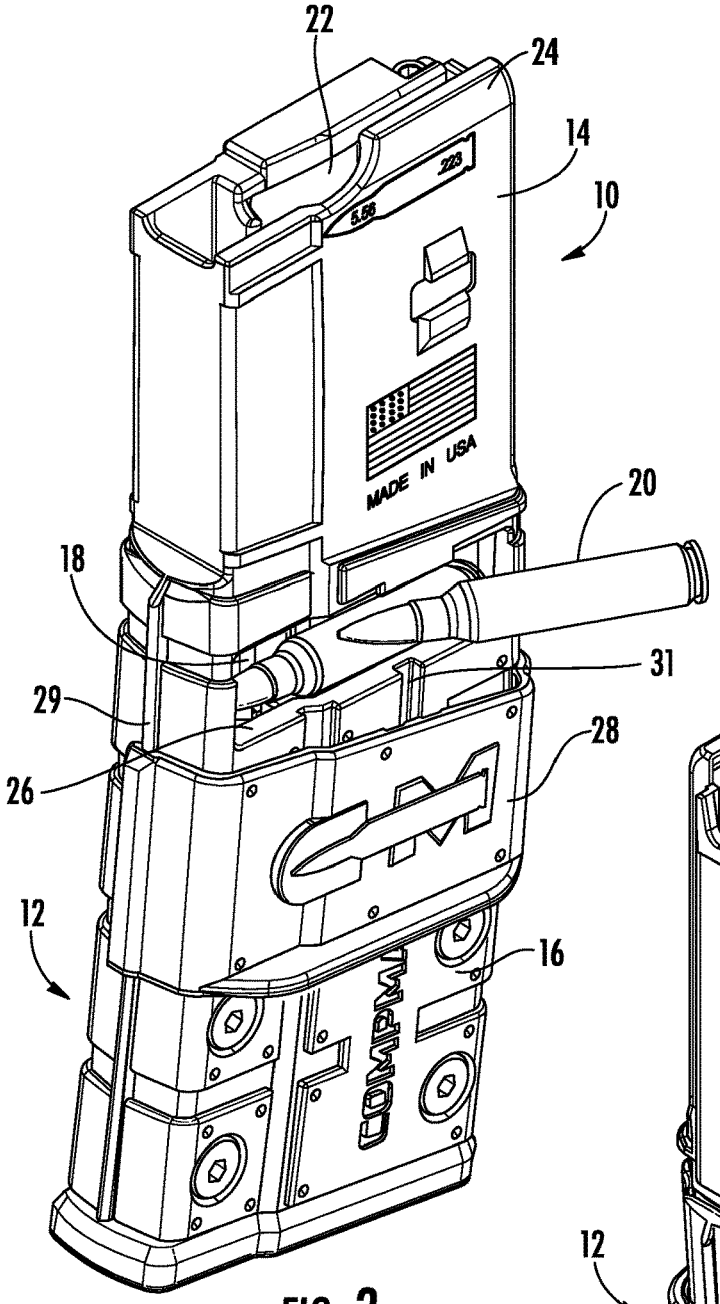
FIG. 3 is an obverse perspective view of the ammunition magazine of FIG. 1, with the cover in the open position, showing cartridges being added to the stack of cartridges.

As best seen in FIG. 3, the housing 12 defines a cartridge-loading compartment 18 configured to receive and contain a stack of ammunition cartridges 20. The upper end of the cartridge-loading compartment 18 terminates in a mouth 22 that communicates with the opening in the receiver and is partially covered by a feed lip 24. The lower end of the cartridge-loading compartment 18 is accessible through a side opening 26 in the lower portion 16 of the housing 12. A cover or door 28 is slidable along at least one side rail 29 to alternately cover or reveal the opening 26. The extent to which the cover 28 can be moved downward is limited by a cover stop groove 31.

Figure 4:
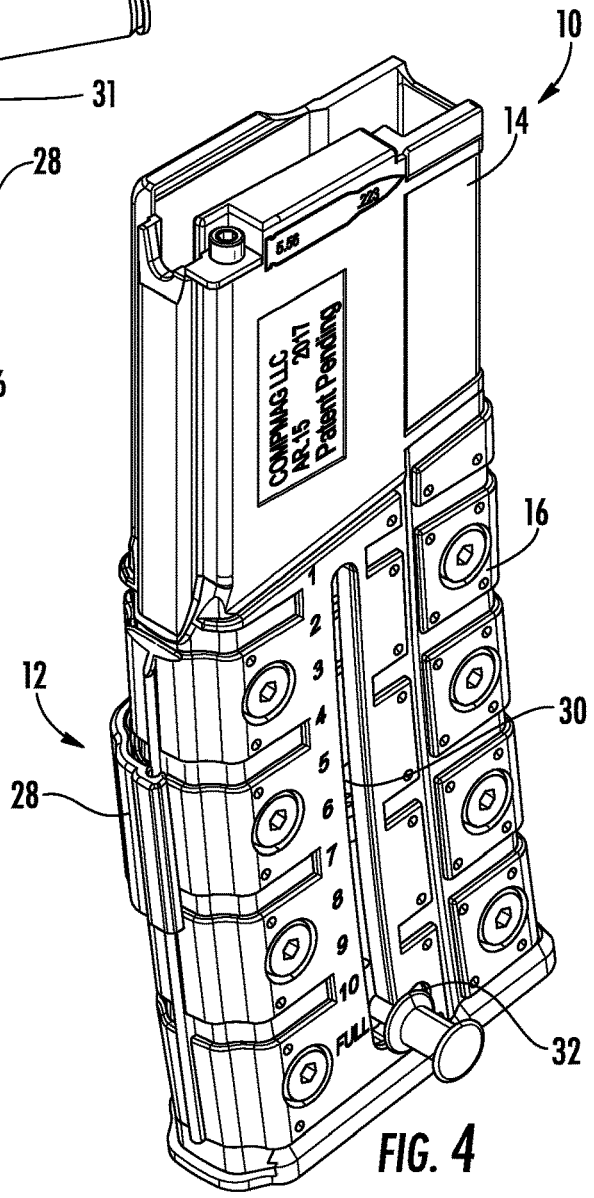
FIG. 4 is a reverse perspective view of the ammunition magazine of FIG. 1, with the finger-pull in the down position.

As best seen in FIG. 4, the side of the housing 12 opposite the slidable cover 28 includes a finger-pull slot 30 that opens into a follower compartment containing a follower assembly for actuating the slidable cover 28. The finger-pull slot 30 has a hook-shaped lower end 32.

Figure 5:
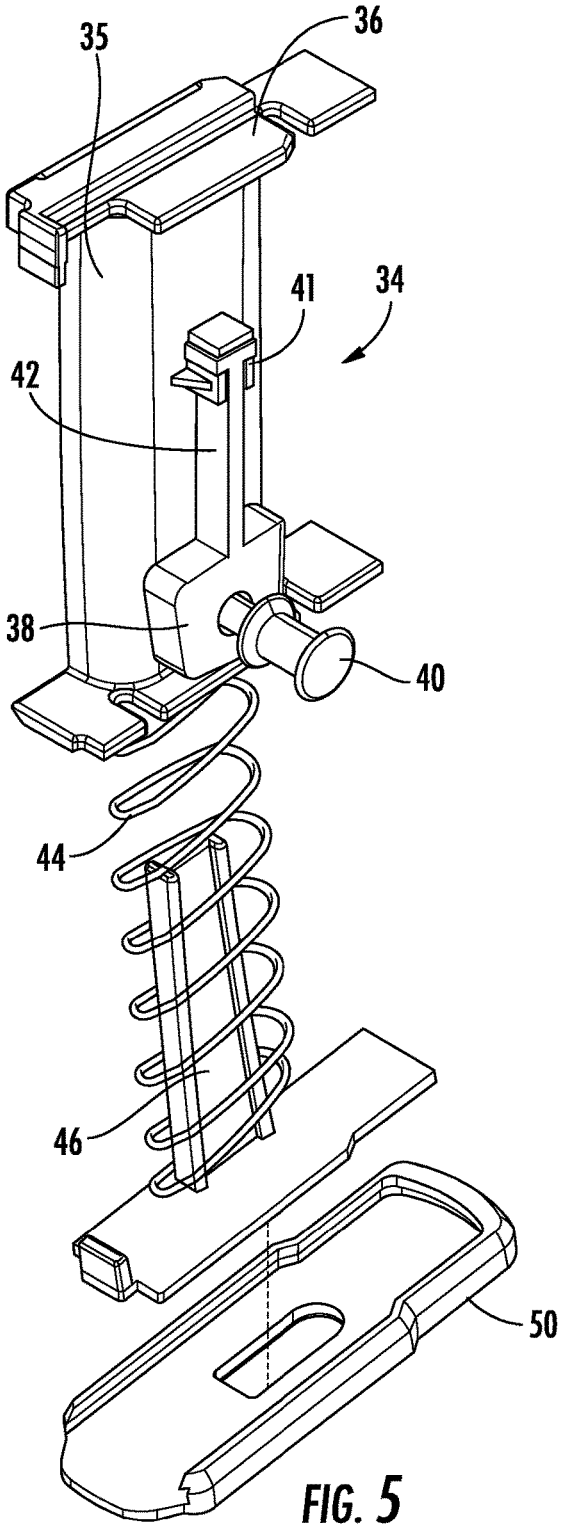
FIG. 5 is an exploded obverse view of a follower assembly and magazine bottom cap according to one aspect of the disclosure.
Figure 6:
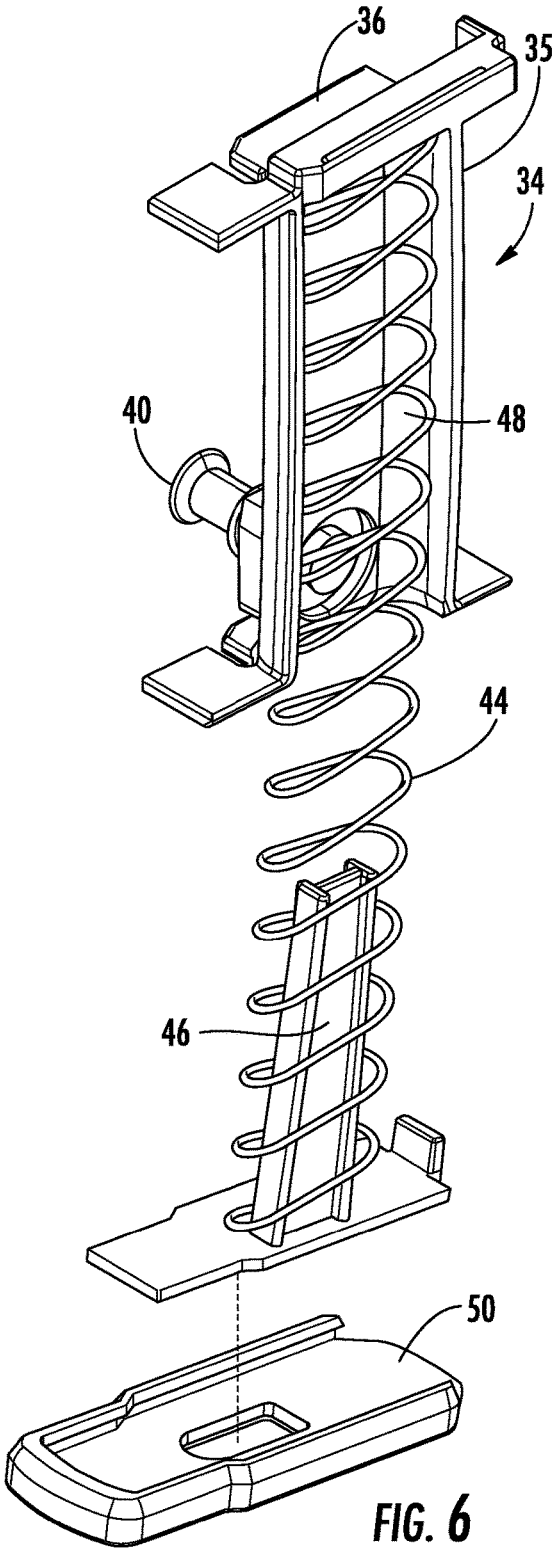
FIG. 6 shows the reverse side of FIG. 5.

The follower assembly 34, shown in FIGS. 5 and 6, includes a follower 35 having a follower top plate 36 that supports the stack of ammunition cartridges. A follower arm 38 provides a fixed attachment point for a finger-pull 40 that slides vertically along the upper portion of the finger-pull slot in the magazine housing and horizontally along the hooked-shaped lower end of the finger-pull slot. A follower arm T-mount 41 provides flexible attachment points for the top of the follower arm 38, allowing the finger-pull 40 to change position when it reaches the hook-shaped lower end of the finger-pull slot. In addition, the stem 42 of the follower arm 38 is thin and flexible, allowing flexible movement of the finger-pull 40 within the hook-shaped lower end of the finger-pull slot.

Movement of the follower top plate 36 is controlled by a spring 44 that is supported and held in alignment by a spring guide 46. The spring guide 46 is contained within the hollow interior 48 of the follower 35 when the spring 44 is compressed. A magazine bottom cap 50 supports the spring guide 46 and also serves as the structural bottom of the follower assembly 34.

Figure 7:
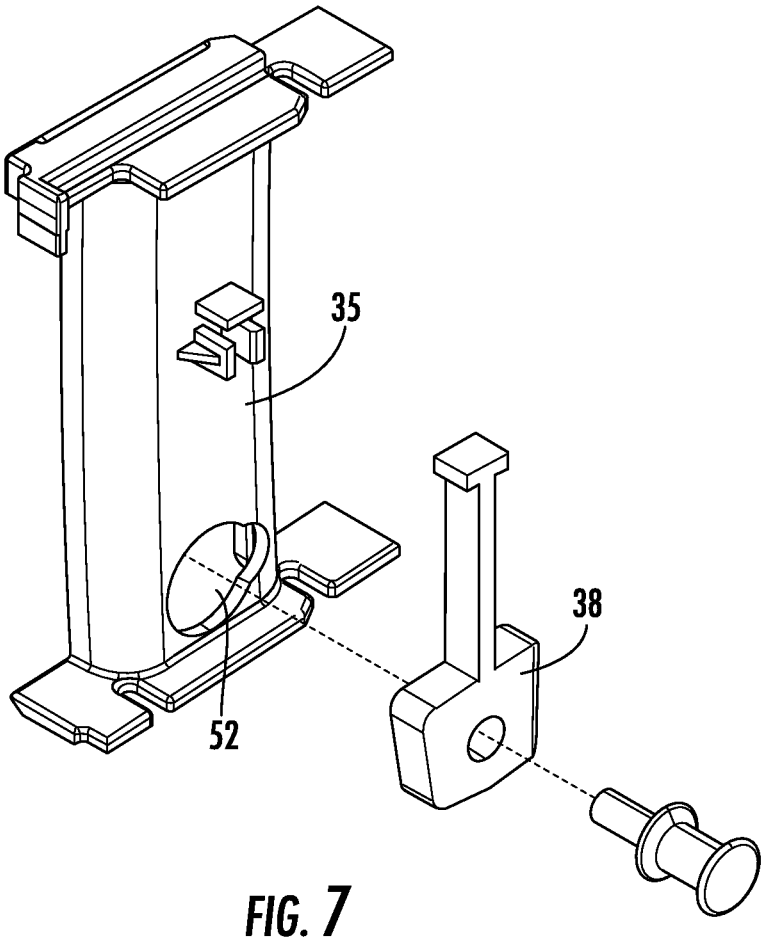
FIG. 7 is an exploded view of the follower, the follower arm, and the movable finger-pull of FIGS. 5 and 6.

As best seen in FIG. 7, the lower end of the follower end 35 defines an open cutout 52 that allows horizontal movement of the follower arm 38, which in turn allows the finger-pull 40 to move flexibly within the hook-shaped bottom end of the finger-pull slot.

Figure 8:
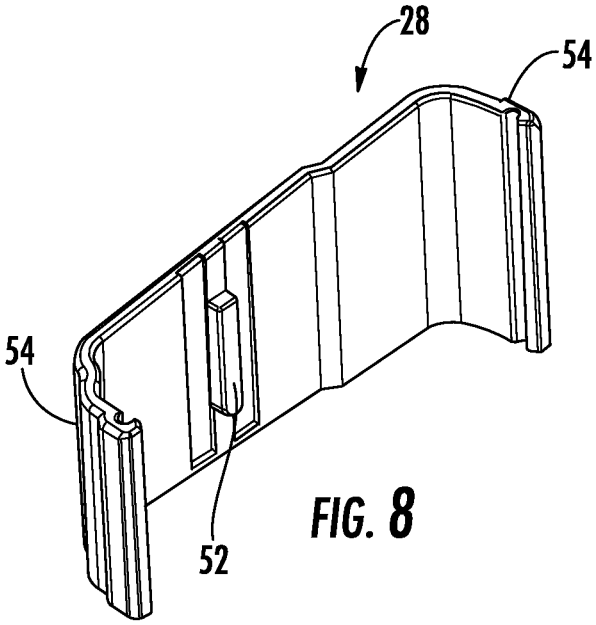
FIG. 8 is an inside perspective view of a cover according to one aspect of the disclosure.

The cover 28 of the magazine housing, shown in FIG. 8, includes a raised cover stop ridge 52 that cooperates with the cover stop groove in one of the side walls of the magazine to prevent the top edge of the cover 28 from traveling below the side opening of the cartridge-loading compartment. The cover 28 also includes a pair of cover grooves 54 that cooperate with the side rails on the magazine housing to slidably support the cover 28.

Figure 9A:
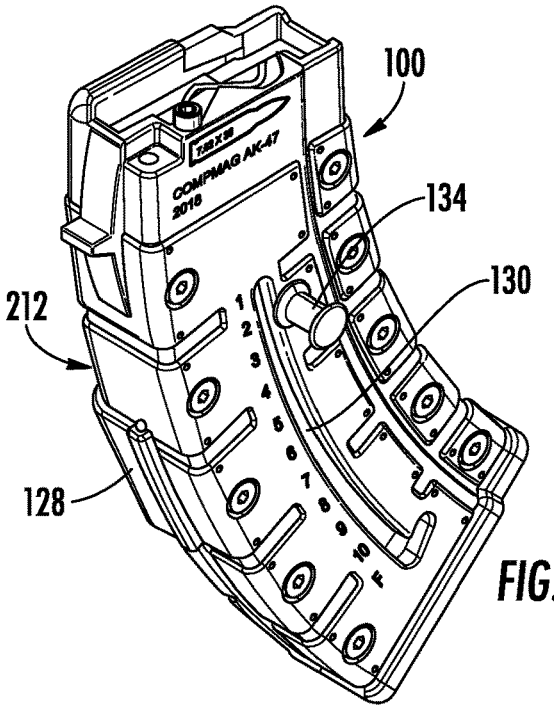
FIG. 9A is a is a perspective view showing an ammunition magazine according to an alternate embodiment of the disclosure.
Figure 9B:
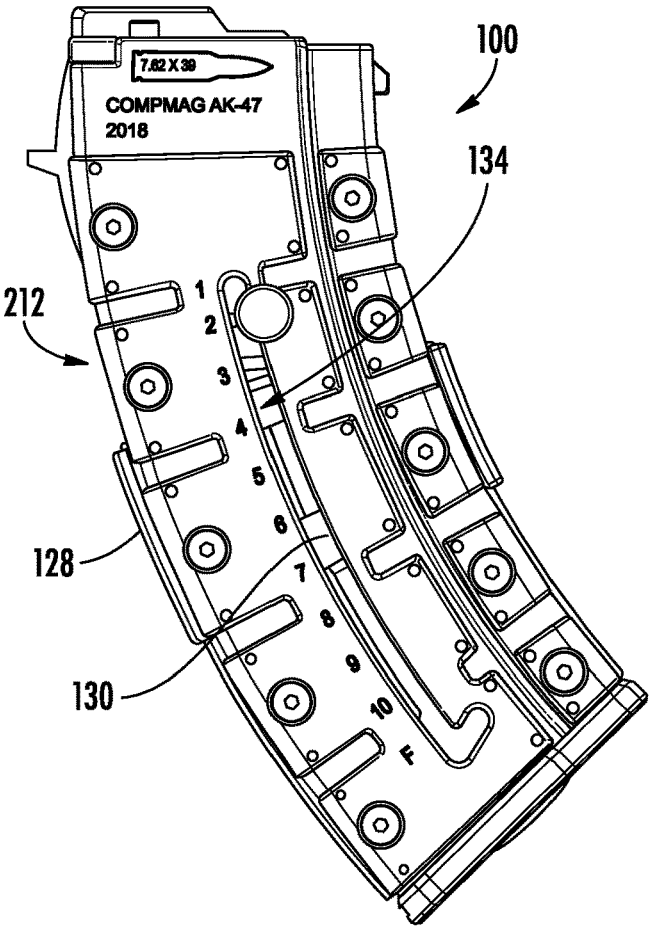
FIG. 9B is an obverse view of FIG. 9A.
Figure 9C:
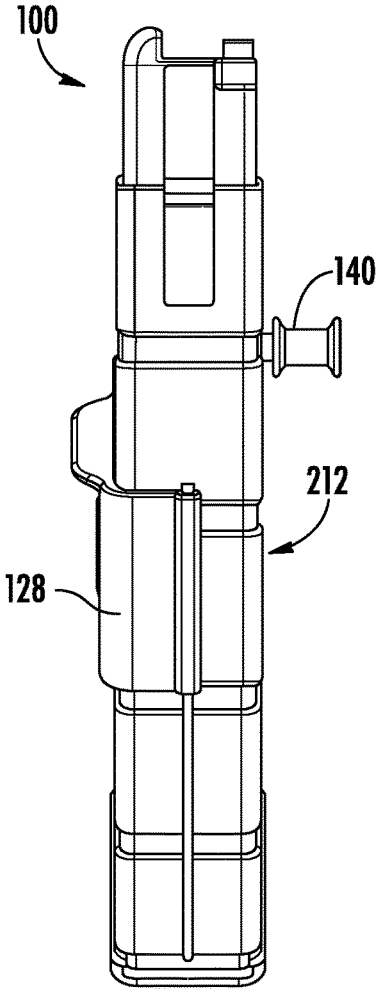
FIG. 9C is a left (rear) side view of FIG. 9A.

FIGS. 9A-C show an ammunition magazine 100 according to the present disclosure, that has been specifically adapted for use with an AK-47-style firearm. The housing 112, cover 128, follower assembly 134, finger-pull 140, and finger-pull slot 130 are essentially the same as their counterparts in FIGS. 1-8, except that the lower portion 116 of the housing 112 is curved to accommodate the geometry of a stack of the cartridges used in an AK-47.

Figure 10:
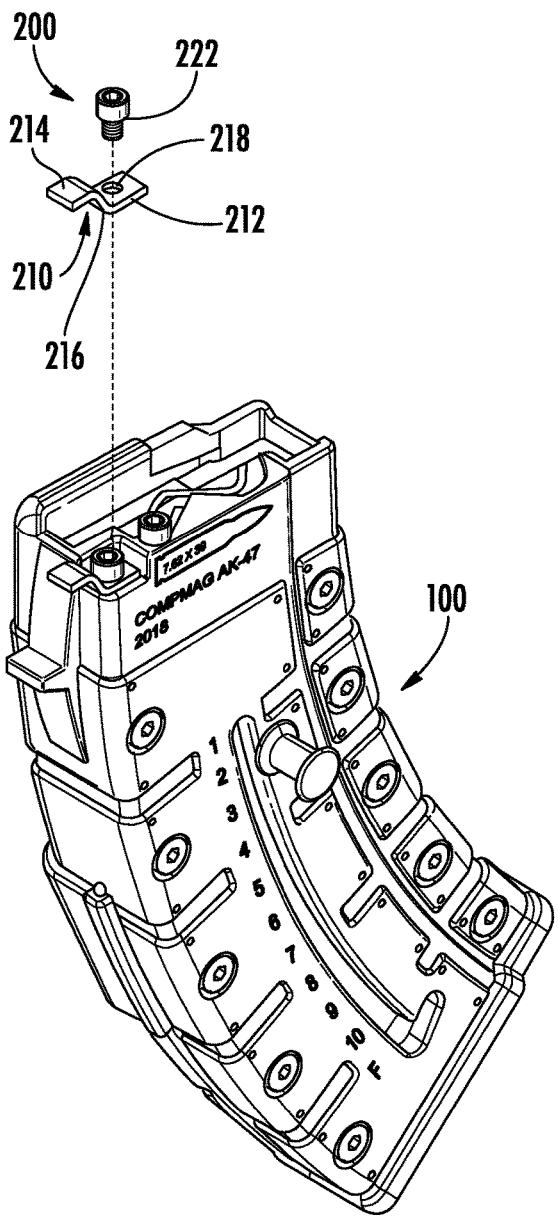
FIG. 10 is a perspective view, similar to FIG. 9A, showing a locking assembly according to a first embodiment of the disclosure, in exploded relationship to the ammunition magazine of FIGS. 9A-9C.

A locking assembly 200 for securing the ammunition magazine 100 to a stamped receiver for an AK-47-type rifle is shown in FIG. 10. The locking assembly 200 includes a locking bar 210 having a horizontal lower front flange 212, a horizontal upper rear flange 214, and a central connector portion 216 that extends diagonally between the front and rear flanges 212, 214. The horizontal lower front flange 212 includes a first opening 218 alignable with a second opening formed in the top wall of the magazine housing 12. The shaft of a screw 222 extends through the aligned first and second openings, thus securing the locking plate 210 to the magazine housing 12.

Figure 12A:
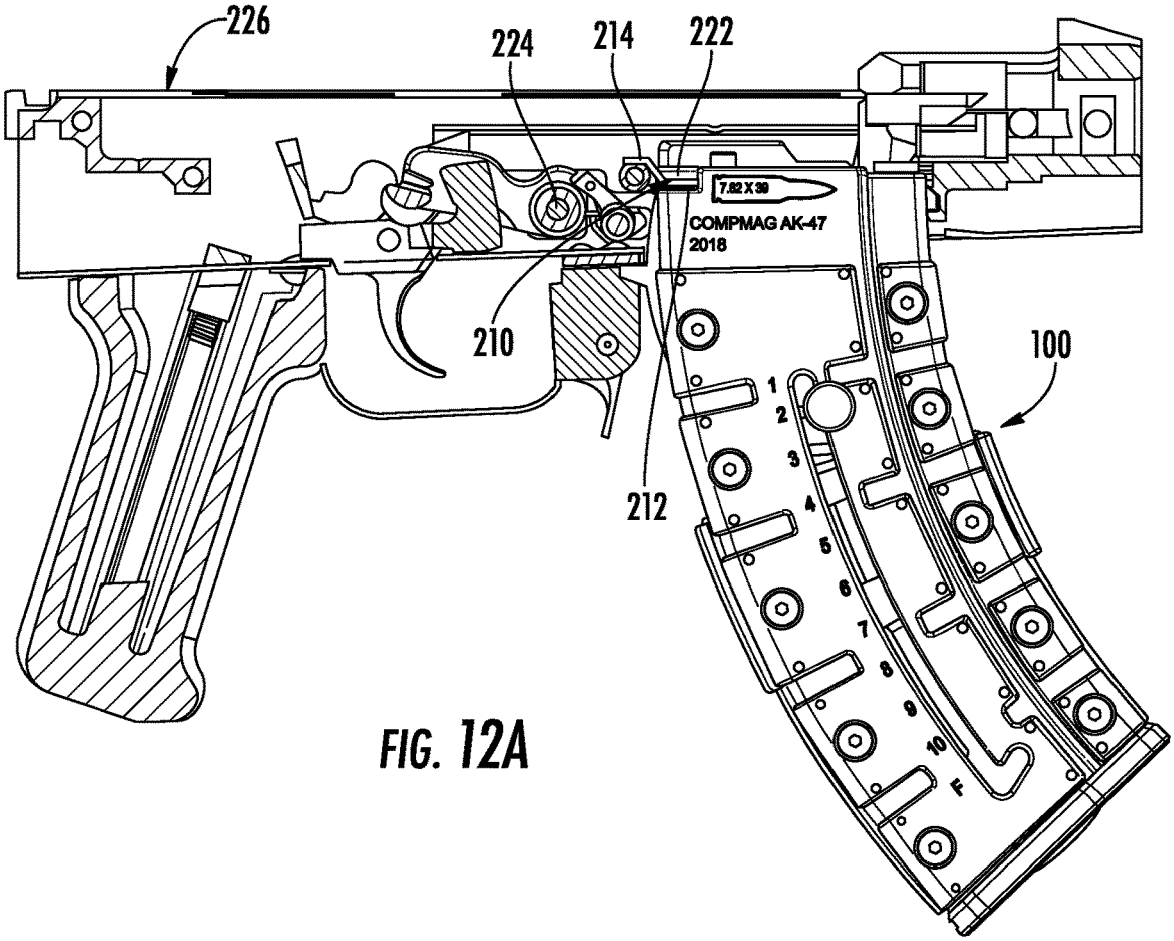
FIG. 12A is a partially sectional view showing the locking assembly of FIG. 10 positioned within a stamped receiver of an AK-47-style rifle.
Figure 12B:
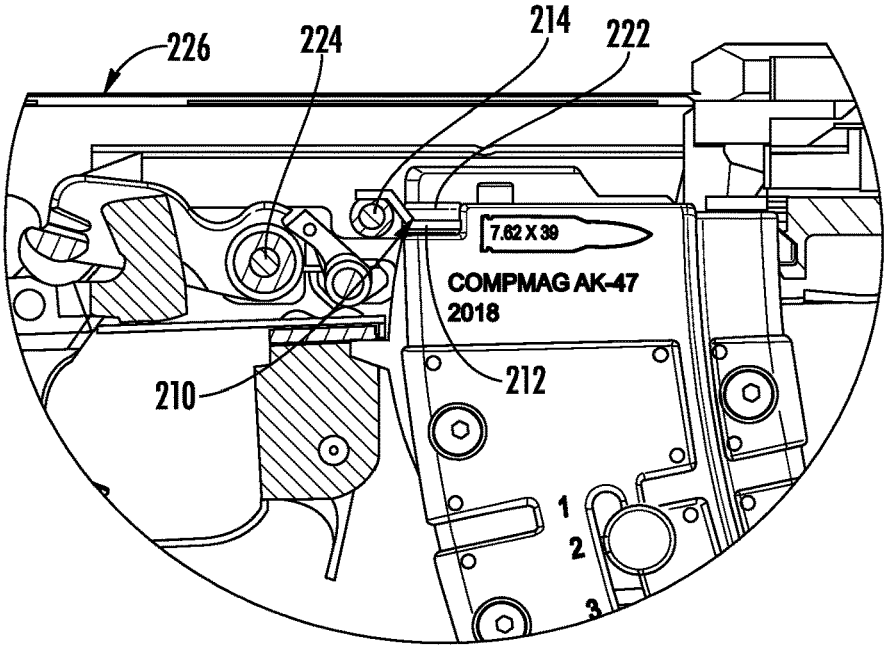
FIG. 12B is an enlarged sectional view of the locking assembly of FIG. 12A.
Figure 13A:
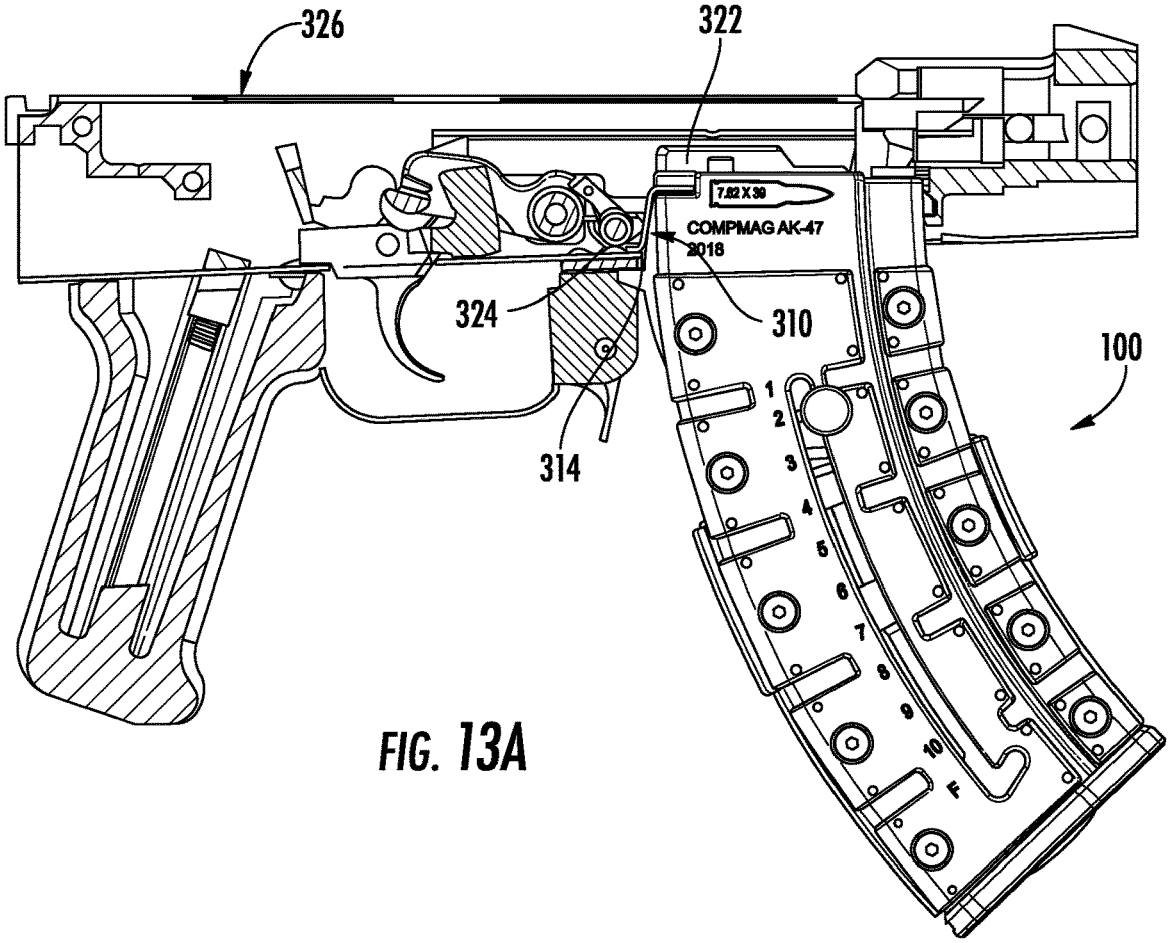
FIG. 13A is a partially sectional view showing the locking assembly of FIG. 11 positioned within a machined receiver of an AK-47-style rifle.
Figure 13B:
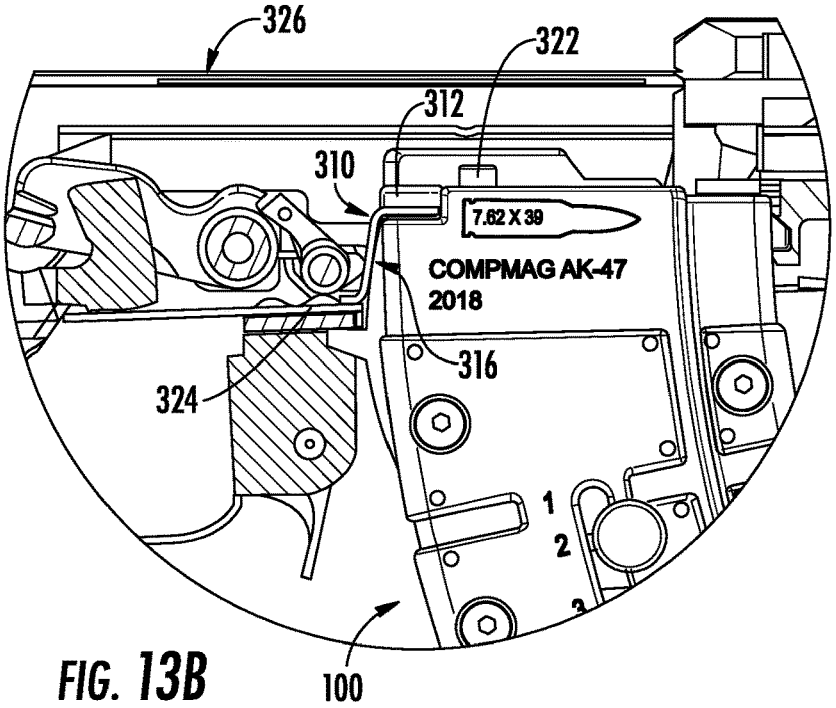
FIG. 13B is an enlarged sectional view of the locking assembly of FIG. 13A.

The horizontal upper rear flange 214 is configured to rest on the cross rivet 224 of the stamped receiver 226, as seen in FIGS. 12A and 12B. As long as the locking plate 210 is installed in this manner, the magazine 10 cannot be detached from the stamped receiver 226.

Figure 11:
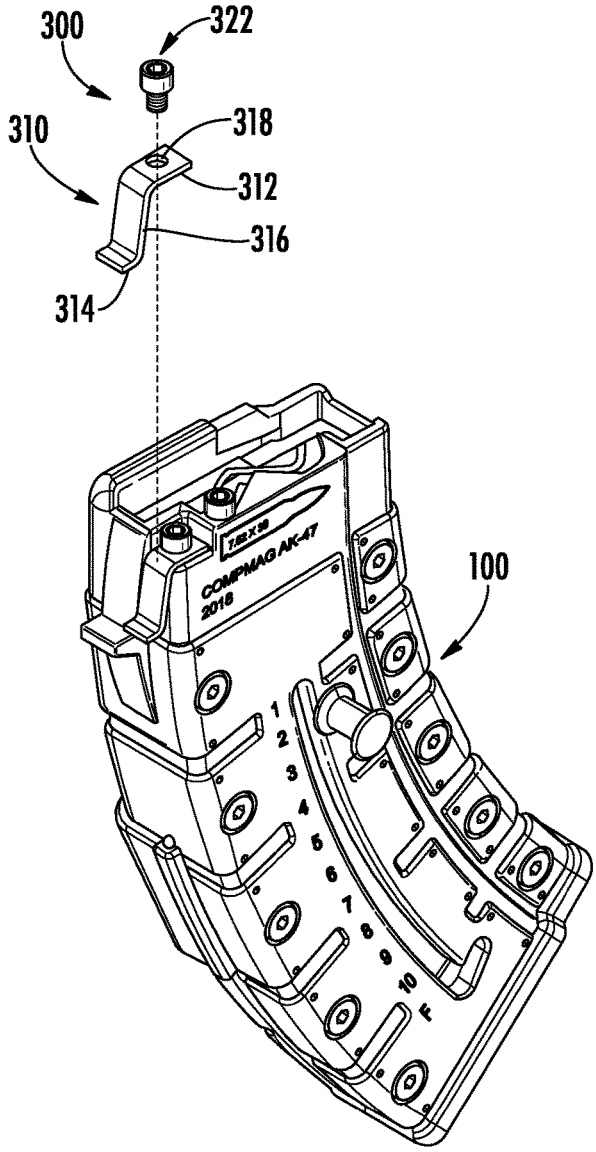
FIG. 11 is a perspective view, similar to FIG. 9A, showing a locking assembly according to another embodiment of the disclosure in exploded relationship to the ammunition magazine of FIGS. 9A-9C.

A locking assembly 300 for securing the ammunition magazine 10 to a machined (or milled) receiver for an AK-47-type rifle is shown in FIG. 11. The locking assembly 300 includes a locking bar 310 having a horizontal upper front flange 312, a horizontal lower rear flange 314, and a central connector portion 316 that extends diagonally between the front and rear flanges 312, 314. The horizontal upper rear flange 314 includes first opening 318 alignable with a second opening formed in the top wall 22 of the magazine housing 12. The shaft of a screw 322 extends through the aligned first and second openings, thus securing the locking plate 310 to the magazine housing 12.

The horizontal lower rear flange 314 is configured to rest on the inner bottom wall 324 of the machined receiver 326, as seen in FIGS. 5A and 5B. As long as the locking plate 310 is installed in this manner, the magazine 10 cannot be detached from the machined receiver 326.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An ammunition magazine for use with a firearm having a receiver, the ammunition magazine including;
- a housing having a top wall defining a first opening; and
- a locking assembly configured to secure the housing to the receiver, the locking assembly including
  - a locking bar having
    - a front flange defining a second opening,
    - and a rear flange configured to rest on a surface within the receiver, and
  - a fastener configured to secure the front flange of the locking bar to the top wall of the housing, the fastener comprising a screw configured to pass through the first and second openings.

2. The ammunition magazine according to claim 1, wherein:
- the receiver is a stamped receiver having a cross rivet; and
- the rear flange of the locking bar is configured to rest on an upper surface of the cross rivet.

3. The ammunition magazine according to claim 2, wherein the locking bar further comprises a connector portion that extends diagonally downwardly from the rear flange to the front flange.

4. The ammunition magazine according to claim 1, wherein:
- the receiver is a machined receiver having a bottom wall; and
- the rear flange of the locking bar is configured to rest on the bottom wall of the receiver.

5. The ammunition magazine according to claim 4, wherein the locking bar further comprises a connector portion that extends diagonally upwardly from the rear flange to the front flange.

6. An ammunition magazine for use with a firearm having a receiver including a lower opening for receiving the ammunition magazine, the ammunition magazine including;
- a housing having a top wall and defining a cartridge-loading compartment and a follower compartment, wherein
  - the top wall defines a first opening, and
  - the cartridge-loading compartment includes
    - an upper end including
      - a mouth communicating with the lower opening, and
      - a lower end accessible through a side opening in the housing;
- a cover coupled to the housing and mounted for movement from a closed position covering the side opening to an open position revealing the side opening;
- a follower assembly mounted within the follower compartment and configured to urge ammunition cartridges in the cartridge-loading compartment toward the mouth of the cartridge-loading compartment; and
- a locking assembly coupled to the housing and configured to prevent the magazine from being removed from the firearm, the locking assembly including
- a locking bar having
  - a front flange defining a second opening,
  - a rear flange configured to rest on a surface within the receiver, and
  - a central connector portion extending between the front and rear flanges, and
- a fastener configured to secure the front flange of the locking bar to the top wall of the housing, the fastener comprising a screw configured to pass through the first and second openings.

7. The ammunition magazine according to claim 6, wherein:
- the follower compartment includes a finger-pull slot having a hook-shaped bottom end; and
- the follower assembly includes
  - a follower that supports the ammunition cartridges;
  - a finger-pull attached to the follower, the finger-pull extending through the finger-pull slot and mounted for vertical movement along finger-pull slot except when retained in the hook-shaped bottom end;
  - a spring configured to be compressed by the follower when the finger-pull is retained in the hook-shaped bottom end, and to expand when the finger-pull is released from the hook-shaped bottom end, thereby allowing the follower to urge the stack of cartridges toward the feeding end of the ammunition magazine.

8. The ammunition magazine according to claim 7, wherein the follower assembly further comprises:
- a spring guide, configured to provide support and stability for the spring and to provide alignment for the spring when in an extended position and when in a compressed position, the spring guide having a shape that fits inside the follower when the spring is in the compressed position; and
- a follower arm, fixedly attached to the finger-pull, with the follower arm also configured to flexibly attach to the follower, so as to allow movement of the finger-pull into the hook-shaped bottom end of the finger-pull slot.

9. The ammunition magazine according to claim 8, wherein the cover includes a pair of cover grooves configured to be slidably supported by a pair of slide rails on the follower compartment.

10. The ammunition magazine according to claim 6, wherein the cover has a raised cover stop ridge that cooperates with a cover stop groove in the follower compartment to prevent the cover from moving below the side opening.

11. The ammunition magazine of claim 6, wherein the follower assembly includes a magazine bottom cap which supports and protects the follower assembly.

12. The ammunition magazine according to claim 6, wherein:

the receiver is a stamped receiver having a cross rivet; and the rear flange of the locking bar is configured to rest on an upper surface of the cross rivet.

13. The ammunition magazine according to claim 12, wherein the connector portion extends diagonally downwardly from the rear flange to the front flange.

14. The ammunition magazine according to claim 6, wherein:

the receiver is a machined receiver having a bottom wall; and the rear flange of the locking bar is configured to rest on the bottom wall of the receiver.

15. The ammunition magazine according to claim 12, wherein the connector portion extends diagonally upwardly from the rear flange to the front flange.

* * * * *